US011767830B2

(12) United States Patent
Storz et al.

(10) Patent No.: US 11,767,830 B2
(45) Date of Patent: Sep. 26, 2023

(54) HYDRAULIC SYSTEM

(71) Applicant: HAWE Altenstadt Holding GmbH, Altenstadt (DE)

(72) Inventors: Martin Storz, Schwabsoien (DE); Albert Schmid, Ingenried-Erbenschwang (DE); Gerhard Huber, Frankenhofen (DE)

(73) Assignee: HAWE Altenstadt Holding GmbH, Altenstadt (DE)

( * ) Notice: Subject to any disclaimer, the term of this patent is extended or adjusted under 35 U.S.C. 154(b) by 557 days.

(21) Appl. No.: 17/047,114

(22) PCT Filed: Apr. 3, 2019

(86) PCT No.: PCT/EP2019/058368
§ 371 (c)(1),
(2) Date: Oct. 13, 2020

(87) PCT Pub. No.: WO2019/197235
PCT Pub. Date: Oct. 17, 2019

(65) Prior Publication Data

US 2021/0156368 A1 May 27, 2021

(30) Foreign Application Priority Data

Apr. 11, 2018 (DE) ..... 102018108638.5

(51) Int. Cl.
*F04B 1/053* (2020.01)
*F04B 1/047* (2020.01)
(Continued)

(52) U.S. Cl.
CPC ..... *F04B 1/053* (2013.01); *F04B 1/047* (2013.01); *F04B 1/0476* (2013.01); *F04B 1/07* (2013.01);
(Continued)

(58) Field of Classification Search
CPC ..... F04B 1/0476; F04B 1/07; F04B 1/0426; F04B 23/06; F15B 11/17;
(Continued)

(56) References Cited

U.S. PATENT DOCUMENTS 4,202,252 A 5/1980 Scheufler et al.
2012/0233997 A1* 9/2012 Andruch, III ..... E02F 9/2217 60/459
(Continued)

FOREIGN PATENT DOCUMENTS

DE 1812533 A1 10/1970
DE 19935854 A1 2/2000
(Continued)

OTHER PUBLICATIONS

International Search Report dated May 29, 2019; International Application No. PCT/EP2019/058368.

*Primary Examiner* — Thomas E Lazo
(74) *Attorney, Agent, or Firm* — DINSMORE & SHOHL LLP

(57) ABSTRACT

A hydraulic system has two hydraulic circuits, each with a pressure generating unit acting on an actuator unit. The generating units are slot-controlled radial piston pumps and form a pump assembly with a single common pump support and single common rotor. The rotor is rotatable on a free protruding section of a common support hub and has piston-receiving bores on axially offset planes. The hub has two first and two second fluid bores. The first bores communicate with first pump connections and first control openings on the hub on a first plane, and the second fluid bores communicate with second pump connections and second control openings on the hub on a second plane. A first and a second adjustment frame, each having an eccentric ring and acting on the pump pistons, are disposed on respective planes perpendicular to
(Continued)

the main axis and independently guided in a linearly movable manner.

18 Claims, 3 Drawing Sheets

(51) Int. Cl.

| | |
|---|---|
| ***F04B 1/07*** | (2006.01) |
| ***F04B 11/00*** | (2006.01) |
| ***F04B 23/06*** | (2006.01) |
| ***F04B 53/16*** | (2006.01) |
| ***F15B 7/00*** | (2006.01) |
| ***F04B 1/0476*** | (2020.01) |

(52) U.S. Cl.
CPC ..... *F04B 11/005* (2013.01); *F04B 23/06* (2013.01); *F04B 53/16* (2013.01); *F15B 7/006* (2013.01); *F15B 2211/20576* (2013.01)

(58) Field of Classification Search
CPC .. F15B 2211/20561; F15B 2211/20576; F15B 2211/71
See application file for complete search history.

(56) References Cited

U.S. PATENT DOCUMENTS

2015/0226234 A1* 8/2015 Amundson ..... F15B 11/04 60/431
2017/0198730 A1* 7/2017 Owada ..... E02F 9/2232

FOREIGN PATENT DOCUMENTS

| | | | |
|---|---|---|---|
| DE | 102004049864 | A1 | 4/2006 |
| DE | 102007021287 | A1 | 12/2007 |
| DE | 102006044300 | A1 | 4/2008 |
| DE | 102008032740 | A1 | 1/2010 |
| EP | 1293667 | A1 | 3/2003 |

* cited by examiner

HYDRAULIC SYSTEM

CROSS-REFERENCE TO RELATED APPLICATIONS

This application is the U.S. national stage of PCT/EP2019/058368 filed Apr. 3, 2019, which claims priority of German patent application 102018108638.5 filed Apr. 11, 2018, both of which are hereby incorporated by reference in their entirety.

FIELD OF INVENTION

The present invention relates to a hydraulic system with a first hydraulic circuit, which comprises a first actuator unit and a first pressure generating unit acting upon it with a reversible pump direction, and a second hydraulic circuit, which comprises a second actuator unit and a second pressure generating unit acting upon it with a reversible pump direction.

BACKGROUND OF INVENTION

Hydraulic systems with hydraulic actuators pressurized by pressure generators (e.g. electrically operated hydraulic power units) are widely used as drive or adjustment systems. This is mainly due to the characteristic advantages of such systems, such as a comparatively high power density, a high flexibility of the implementation of such systems in the respective application environment due to the possibility of spatially separated accommodation of pressure generator on the one hand and actuator on the other hand, and—in case of integration of a pressure accumulator—the possibility of a fail-safe design. The application range of such systems extends from the heaviest mechanical engineering applications to the finest precision engineering applications. If several different adjustment or drive functions are to be carried out independently of each other at a specific technical facility—via two (or more) separate actuators that can be pressurized with pressure medium—this can be realized by means of two different concepts: Either, there is a common pressure generating unit, and the at least two actuators or actuator units are supplied independently of each other via assigned controlled valves, in particular in the form of electrically adjustable proportional valves; such systems are known from DE 199 35 854 A1. Or, as mentioned above, each actuator or actuator unit is assigned its own pressure generating unit which exclusively acts upon it; examples of such hydraulic systems can be found in DE 10 2007 021 287 A1.

DE 10 2006 044 300 A1 reveals a pump arrangement with at least two radial piston pumps, each with its own pump housing. The drive shafts of the at least two radial piston pumps are coupled together in a rotationally fixed manner. Preferably, the pump housings of the at least two radial piston pumps are also rigidly coupled together.

DE 10 2008 032 740 A1 reveals a pump arrangement serving to deliver a fluid with two pump units designed as radial piston pumps that can be driven by a common drive shaft. The two pump units are hydraulically coupled in such a way that a first pump unit is hydraulically followed by a second pump unit.

SUMMARY OF INVENTION

The task of the present invention is to provide a hydraulic system of the type specified at the beginning of this disclosure, which is characterized by its outstanding practical suitability for applications in which, with only a very small space requirement, very precisely coordinated actuations with very high reaction speeds—in particular also with a frequent reversal of the direction of movement in rapid succession—must be possible by means of (at least) two actuator units.

This task is solved, according to the invention, by the implementation of the following characteristic, in combination with each other functional interacting features: The first and the second pressure generating unit are each designed as slot-controlled radial piston pumps. They form a pump assembly with a single, common pump support and a single, common rotor, which is rotatably mounted with respect to a main axis on a free protruding section of a common pump support hub fixed on one side and has pump piston bores arranged in two planes axially offset to each other and serving to accommodate oscillating pump pistons. The pump support hub has two first fluid bores and two second fluid bores, wherein the two first fluid bores communicate with two first pump connections and two first control openings arranged on the pump support hub in a first pump piston plane and the two second fluid bores communicate with two second pump connections and two second control openings arranged on the pump support hub in a second pump piston plane. In the pump support, a first adjustment frame and a second adjustment frame are each accommodated in a plane perpendicular to the main axis and are each independently linearly movably guided, wherein an eccentric ring acting on the pump pistons of the respective associated pressure generating unit is accommodated in each adjustment frame.

The implementation of the present invention makes it possible to realize high-performance hydraulic systems that are extremely compact, i.e. can be used in applications where only a very small installation space is available. In this respect, both the fact that the two pressure generating units, which, due to their design as slot-controlled radial piston pumps with radially inner control openings arranged on the circumferential surface of the pump support hub, only require a minimum of installation space at high performance anyway, can be accommodated in a very small space due to a common rotor, and the fact that only a single motor is required to drive the one common rotor, prove to be favorable. At the same time, excellent performance data can be achieved, especially with regard to reaction speed and other system dynamics. In this respect, it is advantageous that the pump direction of each of the two pressure generating units is changed by moving the associated adjustment frame, so that the direction of rotation of the (common) rotor is not reversed, which would be detrimental to the system dynamics. At the same time, in contrast to the use of flow reversal valves, massive pressure pulses are excluded, because each reversal of the pump direction necessarily passes through the operating point of zero conveying. This has a positive effect on the operating characteristics.

According to a first preferred embodiment of the invention, the two second control openings are rotated with respect to the main axis in the circumferential direction by a primary phase angle to the two first control openings, the primary phase angle—in case of two pressure generating units—being particularly preferably 90°. The advantages associated with this design are particularly pronounced when the displacement direction of the second adjustment frame is rotated in the circumferential direction with respect to the main axis by a secondary phase angle with respect to the displacement direction of the first adjustment frame, wherein the first and the second phase angle are particularly preferably equal in magnitude, so that the secondary phase angle—in the case of two pressure generating units—is also particularly preferably 90°. This design favors both the possibility of minimizing the axial distance between the two pressure generating units, because the angular offset of the first and the second displacement direction by the secondary phase angle prevents the adjustment devices for the two adjustment frames from mutually obstructing each other. In addition, corresponding to the phase offset of the associated control openings, the fluid bores in the pump support hub can be positioned in a particularly favorable manner in the sense that they can have maximum flow cross-sections without having a negative effect on the strength and dimensional stability of the pump support hub. The particularly compact design of the pump assembly is further enhanced by the fact that the pump piston bores of the two radial piston pumps are offset by half a pitch, i.e. they are arranged "on gap"; because this allows a particularly small axial overall length for a comparatively large number of pump pistons with comparatively large diameters without the pump piston bores of the two radial piston pumps being in each other's way.

In the above sense, the two second fluid bores are preferably arranged offset to the two first fluid bores in the circumferential direction with respect to the main axis, wherein particularly preferably the two first fluid bores lie essentially diametrically opposite each other with respect to the main axis in a first reference plane and the two second fluid bores lie essentially diametrically opposite each other with respect to the main axis in a second reference plane and—in the case of two pressure generating units—the first reference plane and the second reference plane are essentially perpendicular to each other.

With regard to particularly favorable operating characteristics, it is also advantageous if at least one of the two adjustment frames is preloaded by means of at least one return spring into a primary end position defining a maximum delivery volume in a primary pump direction. This is because in this way the backlash-free and thus hysteresis-free displacement of the respective adjustment frame in alternating directions via the associated adjustment device is possible, so that maximum reaction speeds can be realized with the highest reproducibility of the operating characteristic curve. In addition, the adjustment device can be designed comparatively simple, in particular by including an adjustment spindle and an adjustment nut acting on the adjustment frame. The two adjustment frames can be arranged adjacent to each other without any gaps, which is advantageous with regard to a particularly small size; in particular, they can slide against each other in the area of opposite end faces.

Another preferred further embodiment of the present invention is characterized by the fact that the rotor and a pot-shaped extension covering the free front side of the pump support hub form a jointly rotating rotor unit, wherein said pot-shaped extension may in particular be designed as an integral part of the rotor and/or as a coupling adapted for connection to a motor shaft. Ideally, the pot-shaped extension has a cylindrical sealing surface, which interacts with a sealing ring arranged on the pump support, preferably accommodated in a pump support cover. Such a design can also contribute to a highly compact pump assembly.

Depending on the individual application situation, different actuator units can be used in the hydraulic system designed in accordance with the invention. In particular, the invention is by no means limited to the use of linear actuators, but rotary actuators can also be used. Among the linear actuators, synchronous cylinders are particularly advantageous, because the elimination of compensating currents—depending on the direction of movement into or out of a tank—means that no discontinuities occur when reversing the direction of flow; this is extremely advantageous for sensitive applications. An at least essentially comparable result can be achieved if the respective actuator unit comprises two mechanically coupled, counter-rotating linear actuators designed as differential cylinders, which are double-acting and hydraulically interconnected crosswise. The latter means that the piston working chamber of one differential cylinder and the piston rod working chamber of the other differential cylinder are hydraulically connected to each other and are jointly pressurized. Depending on the kinematics of the mechanical coupling of the two differential cylinders, a complete or very extensive internal volume compensation is also carried out here, so that compensating flows are completely omitted or at most minimal. Compared to the use of synchronized cylinders, the possibility of realizing higher power densities is advantageous in this case; such actuator units with two mechanically coupled differential cylinders working in opposite directions are particularly preferred for pivoting movements of two articulatedly connected structural elements relative to each other.

Finally, it is particularly advantageous from a manufacturing point of view if the pump support has a pot-shaped pump support housing, wherein the pump support hub forms a separately manufactured component joined to the pump support housing at its base. In the area of the joining surface there are junctions where the fluid channels extending in the pump support hub communicate with fluid channels extending in the pump support housing, which end at the pump connections.

BRIEF DESCRIPTION OF DRAWINGS

In the following, the present invention is explained in more detail by means of a preferred embodiment shown in the drawing. Thereby, it is shown in FIG. 1 is a hydraulic circuit diagram of a hydraulic system according to the invention.

DETAILED DESCRIPTION OF THE INVENTION

Figure 1:
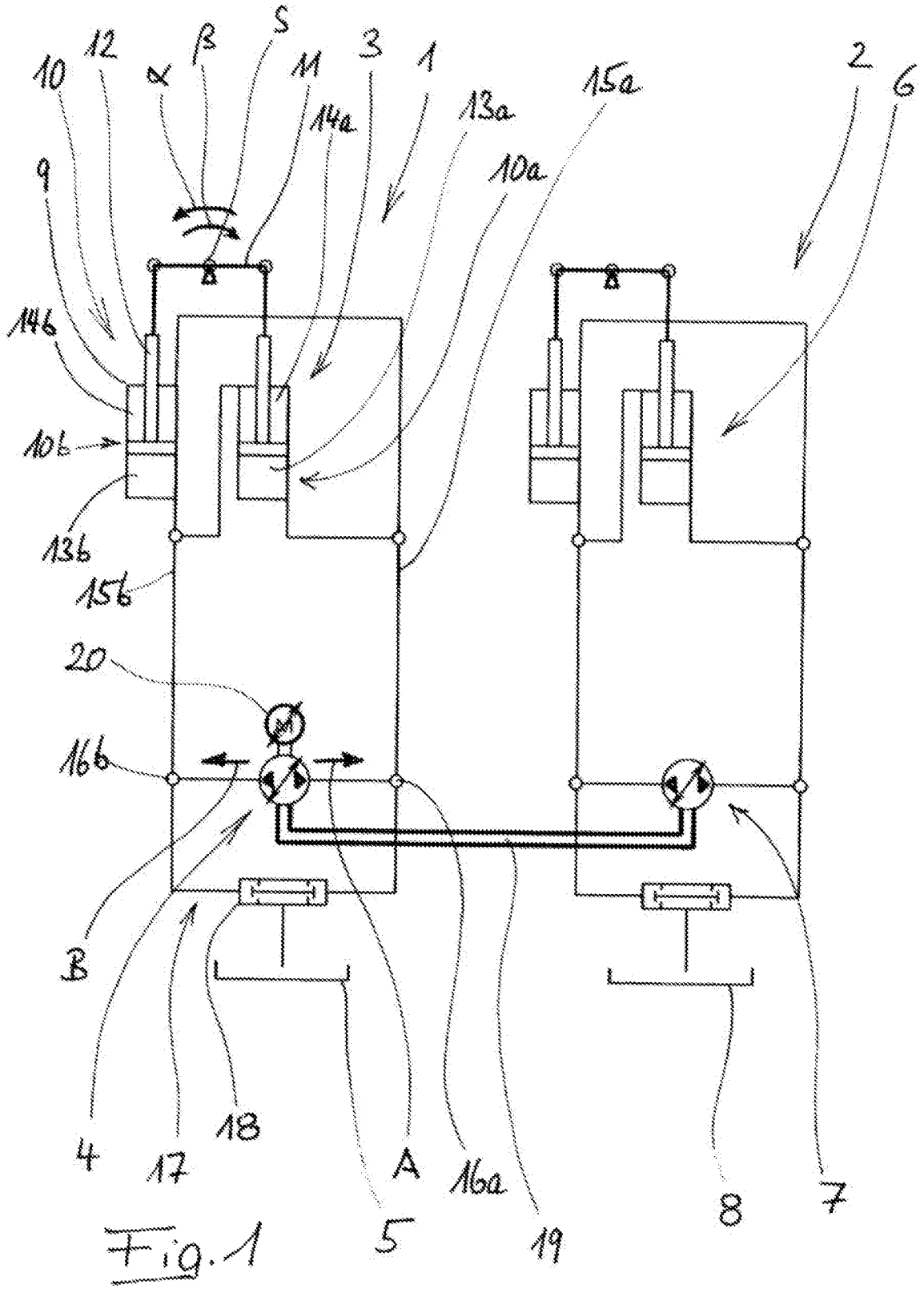

The hydraulic system shown in FIG. 1 comprises a first hydraulic circuit 1 and a second hydraulic circuit 2. The first hydraulic circuit 1 comprises a first actuator unit 3, a first pressure generating unit 4 and a first tank 5. Similarly, the second hydraulic circuit 2 comprises a second actuator unit 6, a second pressure generating unit 7 and a second tank 8. In an alternative configuration, the first and the second tank could be combined into a common tank without this changing the qualification of the two hydraulic circuits 1, 2 as first and second hydraulic circuit, i.e. such a hydraulic connection on the tank side would not prevent the classification of the two hydraulic circuits as first hydraulic circuit 1 and second hydraulic circuit 2 for the purposes of the present invention.

The first actuator unit 3 comprises two linear actuators 10 designed as double-acting differential cylinders 9. These operate in opposite directions in the sense that when the coupling rod 11 is pivoted about a pivot point S, the piston rod 12 retracts for one of the two linear actuators 10 and extends for the other linear actuator 10. The two linear actuators 10 are hydraulically interconnected crosswise with each other in the sense that—for a first pump direction A of the first pressure generation unit 4—the piston working chamber 13*a* of one linear actuator 10*a* and the piston rod working chamber 14*b* of the other linear actuator 10*b* can be pressurized via a common first pressure line 15*a* from a first pump connection 16*a* of the first pressure generation unit 4. Conversely, in a second pump direction B of the first pressure generating unit 4, the piston rod working chamber 14*a* of one linear actuator 10*a* and the piston working chamber 13*b* of the other linear actuator 10*b* can be pressurized via another common second pressure line 15*b* from a second pump connection 16*b* of the first pressure generating unit 4. The first and second pump connections 16*a*, 16*b* of the first pressure generating unit 4 are connected to the first tank 5 via a first equalization line arrangement 17, which includes a first shuttle valve 18. The above explanations apply accordingly to the second hydraulic circuit 2.

As already illustrated in FIG. 1 and explained in detail below with regard to a preferred design implementation, the first pressure generation unit 4 and the second pressure generation unit 7 are not independent of each other; they are rather mechanically coupled to each other, as schematically illustrated in FIG. 1 by the connecting shaft 19. Accordingly, the two pressure generation units 4, 7 have permanently coupled rotors, i.e. rotors driven by a common electric motor 20 in the same direction and at the same speed. The reversal of the pump direction of the respective first or second pressure generating unit 4, 7 is thus affected by an internal adjustment of the respective pressure generating unit 4, 7 (see below), but not by a reversal of the direction of rotation of the electric motor 20 or current reversing valves. The electric motor 20, however, is designed to be speed-variable.

Figure 2:
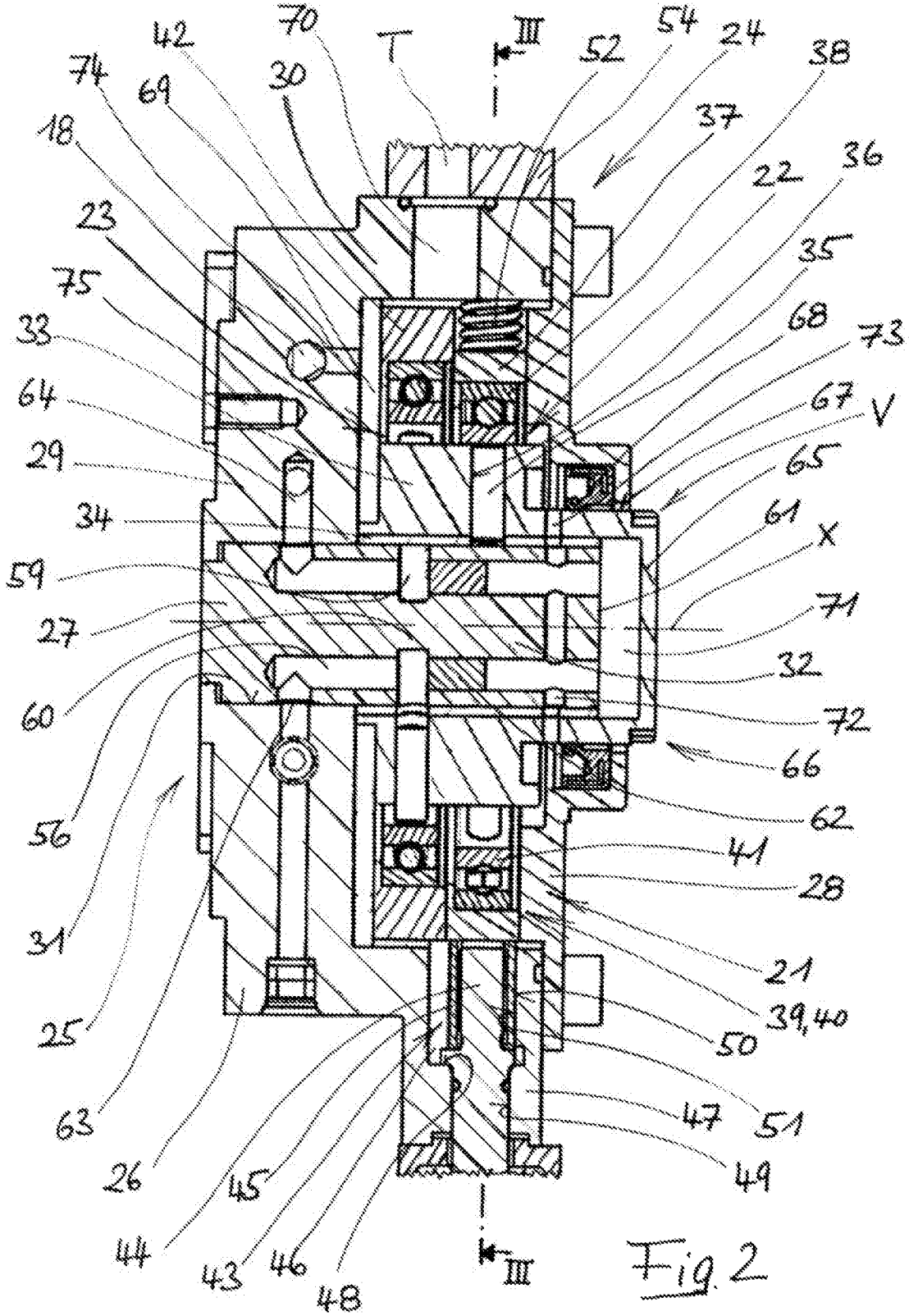
FIG. 2 is an axial section through the double pump used in the hydraulic system according to FIG. 1.
Figure 3:
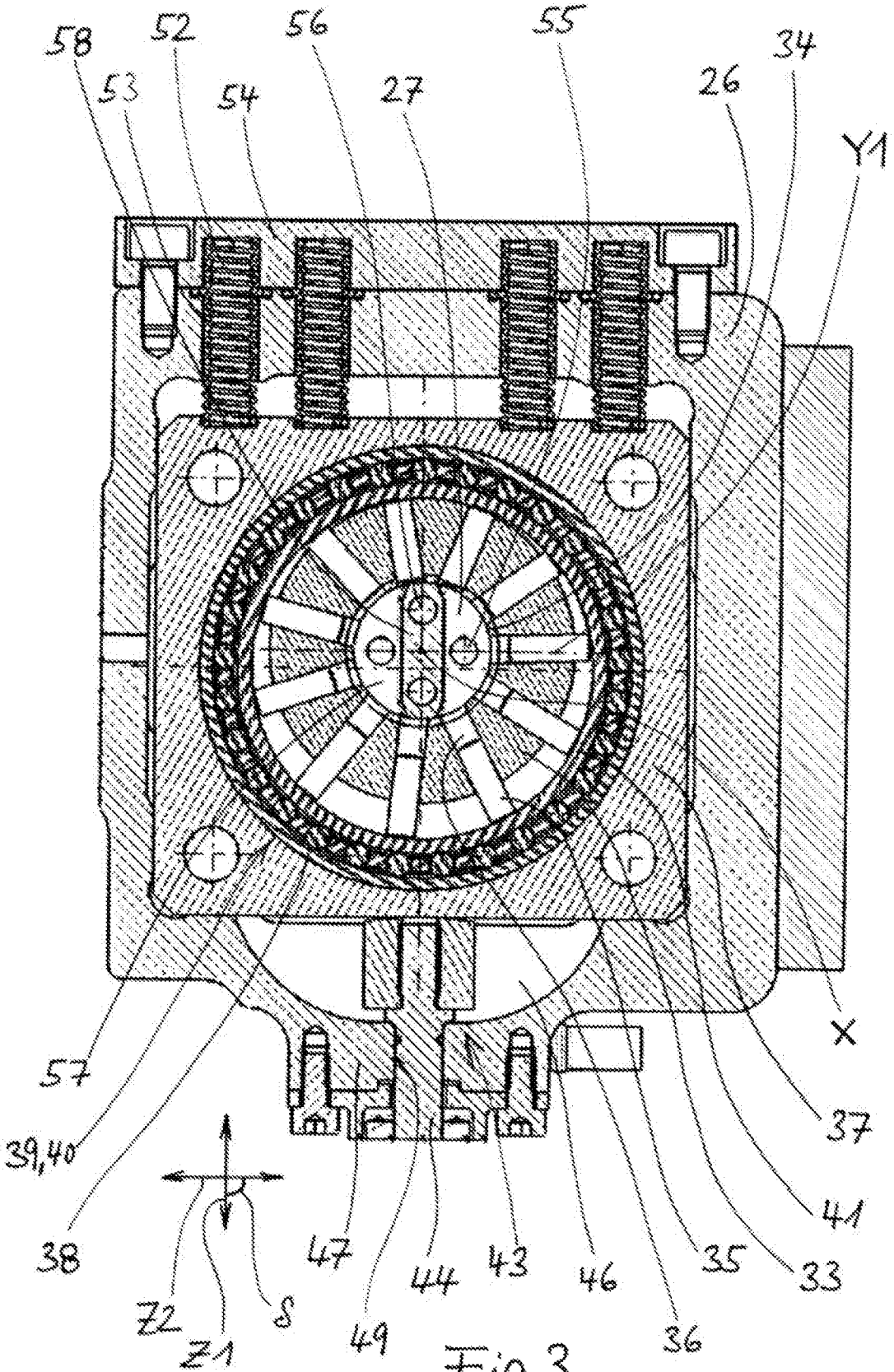
FIG. 3 is a cross-sectional view through the double pump perpendicular to the main axis as shown in FIG. 2 along line (with the rotor slightly rotated relative to the operating position as shown in FIG. 2).

The two pressure generating units 4, 7, which are shown separately in FIG. 1 for reasons of clarity, form a pump assembly 21, as illustrated in detail in FIGS. 2 and 3; they are integrated into a double pump 24 as two slot-controlled radial piston pumps 22, 23, which can be adjusted independently of each other with regard to pump direction and pump rate. This comprises a pump support 25, which in turn has as main components a pot-shaped pump support housing 26, a pump support hub 27 and a pump support cover 28. The pump support 26 comprises a base 29 and a jacket 30. By pressing it into a corresponding bore 31, the pump support hub 27 is joined in the area of its one end to the base 29 of the pump support 26 in such a way that it cantilevers freely in the rest of the housing.

A rotor 33 common to both radial piston pumps 22, 23 is mounted on the free protruding section 32 of the pump support hub 27, so that it can rotate about a main axis X defined by it. For this purpose, the rotor 33 has a wear-resistant slide bearing bushing 34 which is optimized with regard to its sliding properties. Furthermore, the rotor 33 has eleven radial pump piston bores 36 for accommodating oscillating pump pistons 35 in two axially offset planes evenly distributed around the main axis X. The pump piston bores 36 of the two radial piston pumps 22, 23 are offset by half a pitch, i.e. they are arranged "on gap". Furthermore, each of the two radial piston pumps 22, 23 comprises an adjustment frame 37 and 42, respectively. The respective adjustment frame 37, 42 accommodates—with its outer ring 38—a roller bearing 40 forming an eccentric ring 39, the inner ring 41 of which acts radially on the pump pistons 35 of the respective radial piston pump 22 or 23. The two adjustment frames 37, 42 are each accommodated in the pump support housing 26 in planes perpendicular to the main axis X and can be moved linearly and independently of each other; four support lugs (with sliding surfaces) are provided on the pump support housing 26 for the two adjustment frames 37, 42. The displacement direction Z2 of the adjustment frame 42 of the second radial piston pump 23 is perpendicular to the displacement direction Z1 of the adjustment frame 37 of the first radial piston pump 22; i.e. the two displacement directions Z1 and Z2 are offset with respect to the main axis X in circumferential direction by a secondary phase angle δ of 90°.

An adjustment device 43 with an adjustment spindle 44 and an adjustment nut 45 acting on the adjustment frame 37 is used to adjust the adjustment frame 37, i.e. to move it relative to the pump support 25. The adjustment device 43 is accommodated in a recess 46, which is limited by a protrusion 47 of the jacket 30 of the pump support 26. The adjustment spindle 44 is supported by a seat 48, which is located in the aforementioned protrusion 47; its end protrudes from the pump support 26 and is sealed in the bore 49. To prevent the spindle nut 45 from rotating, it rests with a flat sliding surface 50 against a corresponding support surface 51 delimiting the recess 46. On the opposite side, four return springs 52 act on the adjustment frame 37 in such a way that the adjustment frame 37 is pretensioned without play against the spindle nut 45 and in the direction of the primary end position, in which the adjustment frame 37 is located in FIGS. 2 and 3. The bores 53, in which the return springs 52 are accommodated, are closed to the outside by the cover 54. Provided that the displacement direction is rotated by 90° (see above), the above explanations apply accordingly to the adjustment device assigned to the adjustment frame 42 of the second radial piston pump 23.

The pump support hub 27 has two first fluid bores 55 extending parallel to the main axis X and two second fluid bores 56, also extending parallel to the main axis X, offset circumferentially with respect to the main axis X. The fluid bores 55, 56 are diametrically opposed to each other in pairs with respect to the main axis X in the sense that the two first fluid bores 55 define a first reference plane Y1 and the two second fluid bores 56 define a second reference plane Y2, whereby the first reference plane Y1 and the second reference plane Y2 are perpendicular to each other.

Each of the two first fluid bores 55 opens into a crescent-shaped slot-like first control opening 57, communicating therewith, wherein the two first control openings 57 are arranged in the pump piston plane of the first radial piston pump 22 and separated from each other by a first bar section 58 of the pump support hub 27 remaining between them. In a corresponding manner, each of the two second fluid bores 56 opens into a crescent-shaped slot-like second control opening 59, communicating therewith, wherein the two second control openings 59 are arranged in the pump piston plane of the second radial piston pump 23 and separated from each other by a second bar section 60 of the pump support hub 27 remaining between them. The two second control openings 59 are rotated in the circumferential direction with respect to the main axis X by a primary phase angle of 90° to the two first control openings 57. Accordingly, the first and second bar sections 58, 60 extend in mutually perpendicular planes. (For reasons of clarity, the pump piston bores and pump pistons of the second radial piston pump 23, as they would actually be visible through the second control openings 59 in the view according to FIG. 2, are not shown).

Between the respective control opening 57 or 59 and the free face 61 of the pump support hub 27, the two first fluid bores 55 and the two second fluid bores 56 are each closed by a pressed-in plug 62. At their opposite ends, the fluid bores 55, 56 communicate with fluid channels 64 running in the pump support housing 26 via transfers 63, which are located in the area of the joining surface of the pump support hub 27 defined by the bore 31, with fluid channels 64 running in the pump support housing 26, which in turn each end at an associated pump connection 16*a*, 16*b*.

The rotor 33 together with a pot-shaped extension 65 covering the free face 61 of the pump support hub 27, which is an integral part of the rotor 33, forms a jointly rotating rotor unit 66. The rotor 33 is driven via the extension 65 by means of an electric motor 20 (not shown in FIG. 2). Thus, depending on the individual constellation, extension 65 can be designed as a coupling designed for connection to a motor shaft, which is schematically illustrated in FIG. 2 by the gearing Von extension 65. In addition, extension 65 has a cylindrical sealing surface 67, which interacts with a sealing ring 68 accommodated in the pump support cover 28.

Cavity 69 of pump support 25, which accommodates the rotor 33 and the adjustment frames 37, 42 together with the associated adjustment devices 43, is pressure less because it communicates with a tank common to both radial piston pumps 22 and 23. For this purpose, a tank line 70, which passes through the jacket 30 of the pump support 26 and communicates with a tank connection T provided on the upper cover 54, opens into the said cavity 69, which is therefore completely flooded with hydraulic oil. The space 71 between the end face 61 of the pump support hub 27 and the pot-shaped extension 65 of the rotor 33 is also connected to the cavity 69 via the free, open ends of the second fluid bores 56, the cross bore 72 and the radial bores 73 passing through the extension 65 and the plain bearing bushing 34 and is thus pressure relieved. The two shuttle valves 18 (see FIG. 1) located in the pump support 26 are connected to cavity 69 via the corresponding holes 74. Finally, FIG. 2 shows a tapped hole 75, which is used to fasten the pump support 25 to a support structure.

The invention claimed is:

1. A hydraulic system, comprising a first hydraulic circuit having a first actuator unit and a first pressure generating unit acting upon the first actuator unit, the first pressure generating unit having a reversible pump direction;

a second hydraulic circuit having a second actuator unit and a second pressure generating unit acting upon the second actuator unit, the second pressure generating unit having a reversible pump direction;

the first and the second pressure generation unit each being a slot-controlled radial piston pump;

the first and the second pressure generating unit forming a pump assembly comprising;

a single, common pump support with a common pump support hub, the common pump support hub having a fixed side and a free protruding section, the pump support hub further having two first fluid bores and two second fluid bores, the two first fluid bores communicating with two first pump connections and two first control openings arranged on the pump support hub on a first pump piston plane and the two second fluid bores communicating with two second pump connections and two second control openings arranged on the pump support hub on a second pump piston plane; and a single, common rotor mounted on the free protruding section of the common pump support hub so as to be rotatable with respect to a main axis, the rotor having pump piston bores arranged in two planes axially offset relative to one another and serving to receive oscillating pump pistons the pump support having a first adjustment frame and a second adjustment frame, each with an eccentric ring received therein and acting on the pump pistons, the first and second adjustment frame each being received in a plane perpendicular to the main axis and each being guided so as to be linearly movable independently of one another.

2. A hydraulic system according to claim 1, wherein the two second control openings are rotated in the circumferential direction with respect to the main axis by a primary phase angle with respect to the two first control openings.

3. A hydraulic system according to claim 2, wherein the primary phase angle is 90°.

4. A hydraulic system according to claim 1, wherein the two second fluid bores are arranged offset with respect to the main axis in the circumferential direction with respect to the two first fluid bores.

5. A hydraulic system according to claim 4, wherein the two first fluid bores extend substantially diametrically opposite each other with respect to the main axis on a first reference plane and that the two second fluid bores extend substantially diametrically opposite each other with respect to the main axis on a second reference plane.

6. A hydraulic system according to claim 5, wherein the first reference plane and the second reference plane are substantially perpendicular to each other.

7. A hydraulic system according to claim 1, wherein a displacement direction of the second adjustment frame is rotated with respect to the main axis in the circumferential direction by a secondary phase angle relative to the displacement direction of the first adjustment frame.

8. A hydraulic system according to claim 7, wherein the secondary phase angle is 90°.

9. A hydraulic system according to claim 1, wherein at least one of the two adjustment frames is biased by at least one return spring into a primary end position defining a maximum displacement volume in a primary displacement direction.

10. A hydraulic system according to claim 9, further comprising an adjustment device having an adjustment spindle and an adjustment nut acting on the adjustment frame.

11. A hydraulic system according to claim 1, wherein the rotor and a pot-shaped extension covering a free face of the pump support hub form a jointly rotating rotor unit.

12. A hydraulic system according to claim 11, wherein the extension has a cylindrical sealing surface which cooperates with a sealing ring arranged on the pump support.

13. A hydraulic system according to claim 12, further comprising a pump support cover receiving the sealing ring.

14. A hydraulic system according to claim 11, wherein the pot-shaped extension is an integral part of the rotor.

15. A hydraulic system according to claim 11, wherein the pot-shaped extension is designed as a coupling adapted for connection to a motor shaft.

16. A hydraulic system according to claim 1, wherein the pump support has a pot-shaped pump support housing, the pump support hub forming a separately manufactured component joined to the pump support housing at a base of the pump support housing.

17. A hydraulic system according to claim 1, wherein at least one of the actuator units comprises two linear actuators mechanically coupled in opposite directions and designed as differential cylinders.

18. A hydraulic system according to claim 17, wherein the two differential cylinders are double-acting and are hydraulically interconnected crosswise.

* * * * *